United States Patent [19]

Fahey

[11] 4,387,927

[45] Jun. 14, 1983

[54] CHAIR MADE FROM A GARBAGE CAN

[76] Inventor: Robert E. Fahey, 5248 Raintree La., Naples, Fla. 33942

[21] Appl. No.: 236,666

[22] Filed: Feb. 23, 1981

[51] Int. Cl.[3] ..... A47C 1/12

[52] U.S. Cl. ..... 297/445; D6/68; D6/74; 297/463

[58] Field of Search ..... 297/445, 463, 462, 461, 297/440, 192; D6/68, 74; 220/73, DIG. 1; 52/DIG. 9; 4/478, 480, 483, 484

[56] References Cited

U.S. PATENT DOCUMENTS

| | | | |
|---|---|---|---|
| 223,156 | 12/1879 | McClain | 297/445 X |
| 2,264,744 | 12/1941 | Dunham | 297/192 X |
| 2,419,163 | 4/1947 | Pope, Sr. | 297/193 X |
| 2,693,227 | 11/1954 | Holland | 297/193 |
| 2,919,169 | 12/1959 | Jackson | 297/193 X |
| 3,061,373 | 10/1962 | Sarchia | 297/445 X |
| 3,114,574 | 12/1963 | Pryale | 297/193 |
| 3,751,082 | 8/1973 | Somerville | 52/DIG. 9 |
| 3,863,563 | 2/1975 | Popeil | 297/193 X |
| 4,029,232 | 6/1977 | Mania | 220/73 |
| 4,210,363 | 7/1980 | Taipalus | 297/192 |

FOREIGN PATENT DOCUMENTS

| | | | |
|---|---|---|---|
| 1247297 | 9/1971 | United Kingdom | 297/445 |

OTHER PUBLICATIONS

*Popular Science;* Oct. 1938; pp. 180 and 181.

*Primary Examiner*—James T. McCall
*Attorney, Agent, or Firm*—Merrill N. Johnson

[57] ABSTRACT

A novel chair is made from a 30 gallon capacity galvanized sheet steel garbage can and the lid of a 20 gallon capacity garbage can. The back of the chair is formed by cutting away almost half of the upper ten inches of the 30 gallon can and rolling the cut edge of the can over a wire to form an upper edge of the chair similar to the original rim of the can. The seat of the chair is formed by inserting the inverted lid of a 20 gallon can into the 30 gallon can and securing it in a horizontal plane within the 30 gallon can by a plurality of bolts and a series of vertical straps running from the lid to upper rim of the can. A padded cushion is placed upon the inverted lid to serve as the seat of the chair.

5 Claims, 2 Drawing Figures

CHAIR MADE FROM A GARBAGE CAN

BRIEF SUMMARY OF THE INVENTION

The invention relates to novelty chairs and more particularly to a novel chair made from a conventional metal garbage can.

Many types of novelty chairs are known, some of which simulate or made from articles of manufacture which were not originally chairs, such as wooden barrels. Today's leisure time activities, both indoors and out, call for novel furniture that is both comfortable and economical and also a conversation piece in itself.

Accordingly, I have invented a comfortable and economical chair which will serve as a conversation piece since it is made from a conventional garbage can, preferably of 30 gallon capacity and the lid of a 20 gallon capacity garbage can.

The back of my chair is made by cutting away less than half of the upper ten or so inches of the 30 gallon capacity can and rolling the cut edge of the can over a quarter inch diameter wire to form with the remaining upper rim of the can the upper edge of the chair.

The seat of the chair is formed by inserting the inverted lid of a 20 gallon can into the 30 gallon can in a horizontal position just below the cut-away edge and securing the lid in a horizontal plane by a plurality of bolts inserted into a series of matching holes drilled in both the can and lid. Additional security of the lid may be provided by a plurality of straps bolted to the rim of the lid and running vertically up and over the upper rim of the 30 gallon can.

A cushion is placed upon the inverted lid to serve as a padded seat for the chair. In addition, matching back cushions may be provided along the inside back of the chair and secured to the straps supporting the lid.

A decorative protective beading may be installed along all or a part of the rolled upper edge of the chair in the form of plastic tubing slit open and placed over the rolled edge of the chair.

DETAILED DESCRIPTION

While the novel chair which comprises my invention may be made from other containers made of metal or plastics, in its preferred form, my chair is made from a galvanized sheet steel 30 gallon capacity conventional garbage can. For a children's chair or a chair for large adults respectively, a 20 gallon can or a 40 gallon can may be used. For most adults the 30 gallon can is ideal.

Such garbage cans are made by a number of United States manufacturers in frustoconical form about 26 inches in height, with a bottom diameter of 17 inches and a top diameter of 21 inches. The can has two diametrically opposite handles beneath the rim of the can and a dished lid which fits snugly over the rolled rim of the can.

Figure 1:
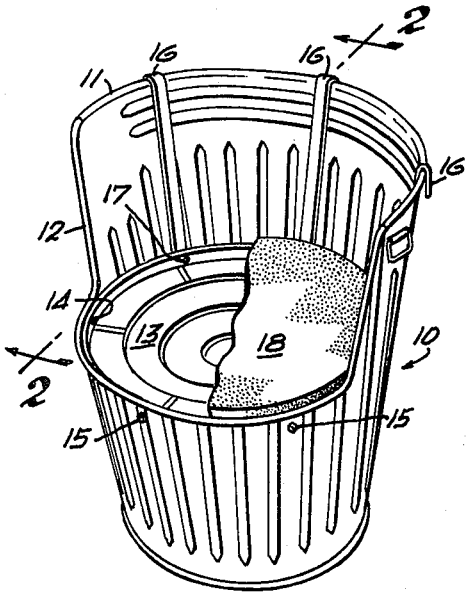
FIG. 1 is a perspective view of a preferred embodiment of my invention with the padded chair seat partially broken away to show the inverted lid supporting the seat.

Referring to the drawing, FIG. 1 shows a preferred form of my invention made from a conventional 30 gallon garbage can 10, a portion of which has been cut away to form the back of the chair. The cutaway portion starts from the rim of the can just beyond the two handles leaving about 39 inches of the rolled rim 11 of the can intact. The cut proceeds down the side of the can at an angle of about 5° to the vertical to a point about 10 inches below the rim and then along a horizontal circumference of the can.

The cut edge of the can is rolled over a one quarter inch wire (as may be the original can rim) in order to present a safe and uniform upper edge 12 of the chair as shown in FIG. 1.

Figure 2:
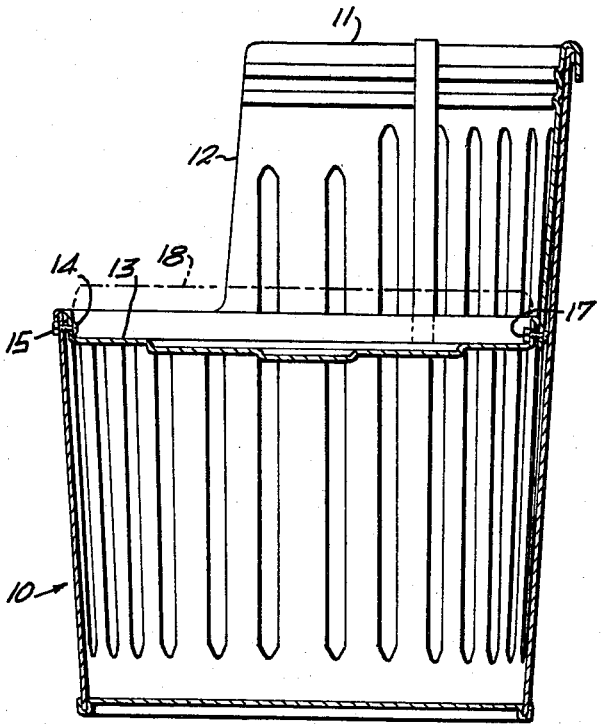
FIG. 2 is a cross sectional view taken along line 2—2 of FIG. 1 with the padded seat in broken lines in order to show more clearly the means by which the inverted lid is mounted to support the chair seat.

Although other means may be used to support the seat of my chair, in its preferred form, the lid from a 20 gallon capacity garbage can is used to support the seat, which lid has a diameter of about 18 inches. Lid 13 is inverted and mounted horizontally within can 10 just below the cutaway portion just described. As shown in the drawings, lid 13 is supported within can 10 by a plurality of bolts 14 which fit into matching holes drilled in the rim of lid 13 and the side of can 10 and are secured by a nut 15, as best shown in FIG. 2. Lid 13 is also supported by a plurality of straps 16 running vertically from the lid up the side of can 10 and over the rim 11 of the can. Each strap 16 may be attached to lid 13 by any convenient means such as bolt and nut 17 best shown in FIG. 2. The straps may be further secured to the can by bolts (not shown) inserted into a series of matching holes drilled in both the straps and the can.

A padded cushion 18 is placed upon lid 13 to serve as the chair's seat. Many different styles and types of seat cushions may be utilized. In addition, matching or contrasting back cushions may be placed along the inside back of the chair and these may be secured to the straps 16 supporting lid 13. Also a decorative or protective beading (not shown) may be installed along all or a part of the rolled rim 11 and upper edge 12 of the chair. Such beading may be a 58 inch length of one half inch diameter plastic tubing slit axially and placed over the rim 11 and edge 12 of the chair.

Having disclosed a preferred embodiment of my invention, those skilled in the art will be able to modify certain aspects of my chair while still utilizing the principle of my invention and it is therefore intended that all such modifications be covered as they are embraced within the scope of the appended claims.

I claim:

1. A novel chair made from a conventional garbage can comprising:

a frustoconical metal can having a flat circular bottom, upwardly flaring frustoconical sides and an open top and having an original capacity in the order of 30 gallons, said can being modified by cutting away a portion of its upper half and leaving at least 50% of the upper half of said can to form the curved back of said chair, a circular member mounted in a horizontal plane within said can just below the cut-away portion of the can to support the seat of said chair, and a cushion of substantially the same diameter as said circular member positioned upon said member to serve as the seat of said chair.

2. The chair of claim 1 wherein the circular member is the inverted lid of a conventional garbage can.

3. The chair of claim 1 or 2 wherein the cut edge of the can is rolled over a wire to form with the original can rim the upper edge of the chair.

4. The chair of claim 2 or 3 in which the lid is secured to the can by a plurality of bolts and a plurality of straps.

5. The chair of claim 4 in which each strap is affixed to the lid and runs vertically along the inside of the can up and over the rim of the can.

* * * * *